US005131864A

United States Patent [19]

Van Zeelst et al.

[11] Patent Number: 5,131,864

[45] Date of Patent: Jul. 21, 1992

[54] DEVICE COMPRISING A CONNECTION MEMBER PROVIDED WITH A SEAL FOR A HIGH-VOLTAGE CABLE

[75] Inventors: Roelof J. A. H. M. Van Zeelst, Tilburg; Johannes H. B. Otten, Eindhoven, both of Netherlands

[73] Assignee: U.S. Philips Corporation, New York, N.Y.

[21] Appl. No.: 691,777

[22] Filed: Apr. 26, 1991

[30] Foreign Application Priority Data

Jun. 14, 1990 [NL] Netherlands ..... 9001351

[51] Int. Cl.[5] ..... H01R 13/58

[52] U.S. Cl. ..... 439/460; 174/65 SS

[58] Field of Search ..... 174/65 SS; 439/460, 439/461, 462; 285/196, 338, 346

[56] References Cited

U.S. PATENT DOCUMENTS

| | | | |
|---|---|---|---|
| 4,016,478 | 4/1977 | Anders et al. | 321/27 R |
| 4,387,267 | 6/1983 | Becker | 174/65 SS |
| 4,596,949 | 6/1986 | Faye et al. | 323/359 |
| 4,738,636 | 4/1988 | Bolante | 439/462 |

*Primary Examiner*—Gary F. Paumen
*Attorney, Agent, or Firm*—Brian J. Wieghaus

[57] ABSTRACT

The connection member comprises an electrically insulating tubular part for introducing the high-voltage cable provided with an insulation sheath. The tubular part is provided at its free end with a tubular extension part, whose inner diameter is larger than the inner diameter of the tubular part and in which an elastic electrically insulating sealing member is arranged. The sealing member is a hollow cylinder, whose outer diameter is at most equal to the inner diameter of the extension part and whose inner diameter is substantially equal to the outer diameter of the insulation sheath. In the extension part a tubular pressure member is arranged, which in a first position does not deform the sealing member and, after the high-voltage cable has been introduced, can be pressed further into the extension part until it occupies a second position, in which it compresses the sealing member in axial direction so that the sealing member completely fills the space between the insulation sheath and the inner surface of the extension part. The compressed sealing member forms a seal, preventing dirt and moisture from penetrating into the tubular part.

12 Claims, 1 Drawing Sheet

DEVICE COMPRISING A CONNECTION MEMBER PROVIDED WITH A SEAL FOR A HIGH-VOLTAGE CABLE

BACKGROUND OF THE INVENTION

The invention relates to a device comprising an electrically insulating housing and a connection member for connecting a high-voltage cable provided with an insulation sheath, which connection member has an electrically insulating tubular part, a first end of which is located within the housing and is provided with a contact member, while a second end projects from the housing, the inner diameter of this part being at least equal to the outer diameter of the insulation sheath.

The device may be, for example, a high-voltage generator for producing a high direct voltage for a cathode-ray tube in a television receiver. Examples of such high-voltage generators are described in U.S. Pat. No. 4,016,478 (PHN. 7690) and in U.S. Pat. No. 4,596,949 (PHF. 84535). The connection between the high-voltage generator and the cathode-ray tube is established by means of a high-voltage cable, which has an electrical conductor surrounded by an insulation sheath. This cable can be provided after the high-voltage generator has been mounted in a television receiver. In television receivers, the high-voltage generator consists of a transformer with a number of rectifiers. The core of the transformer is located outside the insulating housing and does not convey a voltage with respect to the environment. The voltage at the free end of the cable is high, for example about 30 kV, and thus it is possible that with a high relative humidity leakage currents are obtained from the end of the cable to the core or to other components outside the insulating housing. The tubular part of the connection member has for its object to reduce the formation of such leakage currents in that the leakage path for these currents is lengthened. In many cases, this solution is satisfactory, but it has been found that in a very dirty and humid environment inadmissible leakage currents can nevertheless occur. A solution for this problem could consist in that the tubular part is made considerably longer, but this solution has the disadvantage that the device then occupies a very large space and is vulnerable because the long tubular part is liable to break off.

SUMMARY OF THE INVENTION

It is an object of the invention to provide a device of the kind mentioned in the opening paragraph, in which the occurrence of leakage currents via the surface of the tubular part, also in a very humid and dirty environment, is prevented without the length of the tubular part being particularly large.

The device according to the invention is for this purpose characterized in that the tubular part is provided at its second end with a tubular extension piece, whose inner diameter is larger than the inner diameter of the tubular part, and in which an elastic electrically insulating sealing member is located, which takes the form of a hollow cylinder, whose outer diameter is at most equal to the inner diameter of the extension piece and whose inner diameter is substantially equal to the outer diameter of the insulation sheath, and in that a tubular pressure member can be arranged in the extension piece in a first position, in which the sealing member is not deformed, which pressure member, after the high-voltage cable has been introduced, can be pressed further into the extension piece until it occupies a second position, in which it compresses the sealing member in axial direction so that the sealing member completely fills the space between the insulation sheath and the inner surface of the extension piece, in which second position the pressure member can be immovably connected to the extension piece.

The axially compressed sealing member forms a substantially hermetic seal with the tubular part so that moisture and dirt cannot penetrate into this part and consequently cannot influence the formation of leakage currents.

The pressure member can be fixed in different ways with respect to the extension piece, for example by means of a screw connection. A very simple method of fixing is possible in an embodiment of the device according to the invention, which is characterized in that the pressure member is provided with resilient tongues, which, after the pressure member has been arranged in the extension piece, extend along the outer surface of the extension piece in axial direction towards the tubular part and are provided near their free ends with locking members, which for immovably connecting the pressure member to the extension piece can cooperate with first projections in the form of barbed hooks on the outer surface of the extension piece.

A further embodiment of the device according to the invention is characterized in that the outer surface of the extension piece is further provided with second projections in the form of barbed hooks, which are arranged at a greater distance from the tubular part than the first projections in the form of barbed hooks and can cooperate with the locking members of the resilient tongues for securing the pressure member on the extension piece in the first position. This embodiment has the advantage that the pressure member, also before the cable is introduced, is undetachably connected to the tubular part and consequently cannot be lost before or during the operation of mounting the device in, for example, a television receiver.

Although the insulation sheath of the high-voltage is surrounded with clamping fit by the sealing member, this generally does not sufficiently guarantee that the electrical and mechanical contact between the free end of the cable and the contact member is not interrupted when the cable is subjected to tensile stress. Therefore, it is generally necessary to provide a separate tensile relief member. This may be one of the large number of known tensile relief members. The presence of the pressure member makes it possible, however, to combine the tensile relief member with this pressure member, as a result of which a very simple construction with a minimum number of components is obtained. An embodiment of the device according to the invention, in which this is the case, is characterized in that the pressure member is provided at the end remote from the tubular part with a tubular holder, in which a tensile relief member is secured in such a manner that it is movable in axial direction with respect to the pressure member over a distance which is at least equal to the distance over which the pressure member must be displaced to be passed from the first to the second position.

The tensile relief member preferably consists of a ring, at which at least two resilient tongues are present, which extend in axial direction towards the tubular part and are provided at their inner surface with third projections in the form of barbed hooks, which project over such a distance that they penetrate, after the high-voltage cable has been introduced, into the insulation sheath.

These and other aspects of the invention will be described with reference to the drawing.

BRIEF DESCRIPTION OF THE PREFERRED EMBODIMENTS

FIG. 1 shows diagrammatically a side elevation of an embodiment of a device according to the invention, FIG. 2 is a longitudinal sectional view of a part of the device shown in FIG. 1, in which the pressure member is in a first position, and FIG. 3 shows a longitudinal sectional view corresponding to FIG. 2, in which the pressure member is in a second position.

DESCRIPTION OF THE PREFERRED EMBODIMENTS

Figure 1:
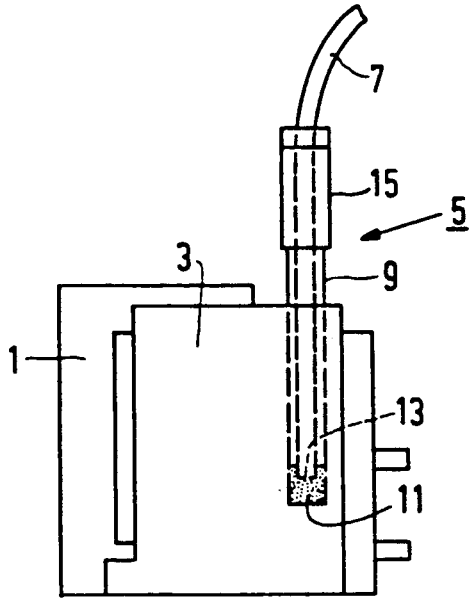

FIG. 1 shows as an embodiment of a device according to the invention a line output transformer for a television receiver, which has inter alia for its object to produce a high direct voltage (for example 30 kV) for a cathode-ray tube. This line output transformer comprises a transformer core 1 of ferrite and an electrically insulating housing 3 of a suitable synthetic material. The housing 3 accommodates a high-voltage winding and a number of rectifiers (not shown). The housing 3 is provided with a connection member 5 for connecting a high-voltage cable 7, whose outer side is constituted by an insulation sheath. The connection member 5 comprises a tubular part 9, which is made of an electrically insulating material, for example the same material as that of the housing 3. The tubular part 9 comprises a first end located within the housing 3 and provided with a contact member 11, which can make electrical contact with a complementary contact member 13 at the free end of the cable 7. The contact member 11 may comprise, for example, an electrically conducting caoutchouc or rubber, into which the free end of the conducting core of the cable 7 freed from its insulating sheath can be inserted. The second end of the tubular part 9 projects from the housing 3 so that the cable 7 can be introduced via this end. The inner diameter of the tubular part 9 is at least equal to and preferably slightly larger than the outer diameter of the insulation sheath of the high-voltage cable 7 so that the cable can be readily introduced into the tubular part until the contact members 11 and 13 are connected to each other in an electrically conducting manner. The tubular part 9 has for its object to make the leakage path between the contact member 11 and parts which are at earth potential (more particularly the core 1) so long that the occurrence of leakage currents is prevented. It has been found, however, that a leakage path which in normal conditions is sufficiently long to achieve this object has proved to be too short when the device is situated in a very humid and dirty environment. In this case, dirt and moisture are deposited on the inner surface of the tubular part 9, as a result of which this surface becomes more or less electrically conducting so that leakage currents occur between the contact member 11 (30 kV) and the core (0 V).

In order to prevent dirt and moisture from penetrating into the tubular part 9, this part is provided with a sealing device 15, which seals the interior of the tubular part substantially hermetically from the environment.

Figure 2:
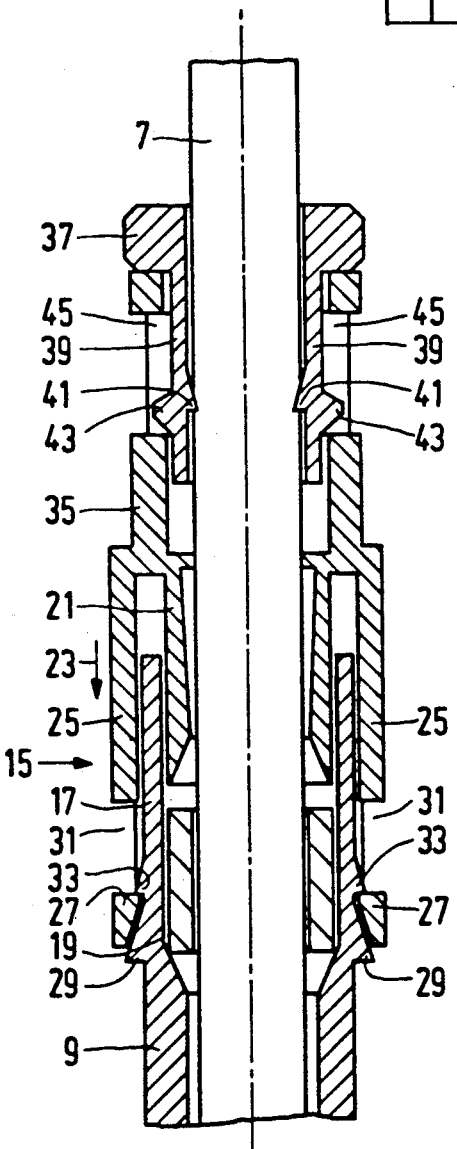
Figure 3:
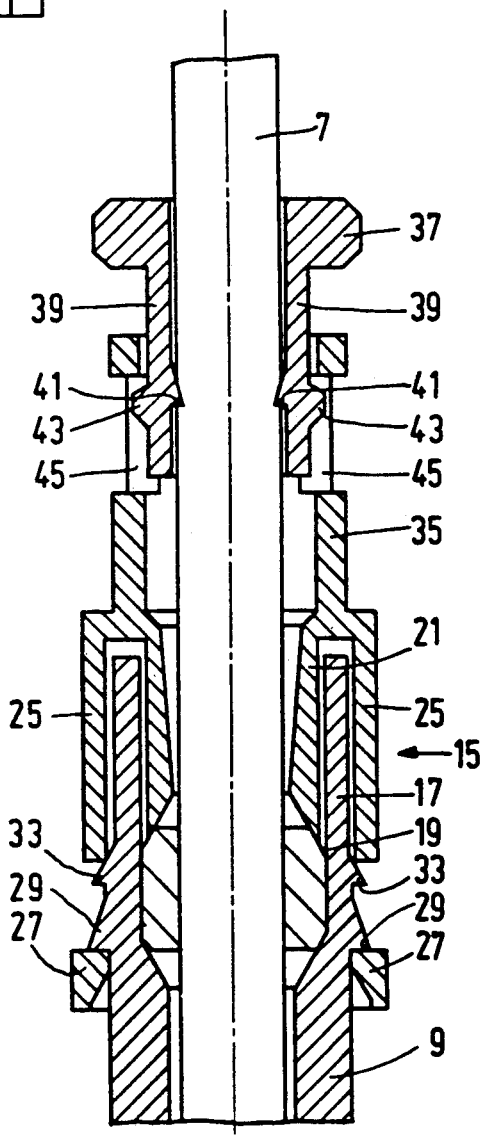

The construction and the operation of the sealing device 15 will now be explained more fully with reference to FIGS. 2 and 3, which show in a longitudinal sectional view the second end of the tubular part 5 with the sealing device. FIG. 2 shows the sealing device 15 in the non-activated state and FIG. 3 shows this device in the activated state.

The sealing device 15 comprises a tubular extension part 17, which is formed at the second end of the tubular part 9 and whose diameter is larger than the inner diameter of the tubular part. In the extension part 17, a sealing member 19 is present, which is made of elastic electrically insulating material (for example a suitable kind of rubber) and has in the rest or uncompressed condition the form of a hollow cylinder. The outer diameter of the sealing member 19 in the rest condition is substantially equal to (preferably slightly smaller than) the inner diameter of the extension part 17 and its inner diameter is at least equal to and preferably slightly larger than the outer diameter of the insulation sheath of the high-voltage cable 7. As a result, the high-voltage cable 7 can be readily introduced via the sealing member 19 into the tubular part 9, as can be seen in FIG. 2.

In the extension part 17, a likewise tubular pressure member 21 is arranged, which in FIG. 2 is in a first position, in which the sealing member 19 is not deformed and is consequently in its rest condition. After the high-voltage cable 7 has been introduced, the pressure member 21 can be pressed into the extension part 17, as is indicated by the arrow 23. The pressure member 21 then compresses the sealing member 19 in axial direction, as a result of which the sealing member expands in radial direction so that it completely fills the annular space between the insulation sheath of the cable 7 on the one hand and the inner surface of the extension part 17 on the other hand, as can be seen in FIG. 3. The sealing member then seals the interior of the tubular part 9 substantially hermetically from the environment so that dirt and moisture can no longer penetrate.

The pressure member 21 is then in a second position. In this second position the pressure member 21 can be immovably connected to the extension part 17. This can be effected in a number of different known ways, for example by means of a screw connection. In the embodiment shown, the fixation is effected in a very simple manner by means of a snap connection. For this purpose, the pressure member 21 is provided with two diametrically arranged resilient tongues 25, which extend outside the extension part 17 in axial direction and are directed towards the tubular part 9. Near its free end each tongue 25 is provided with a locking member 27, which can cooperate with a first projection 29 in the form of a barbed hook on the outer surface of the extension part 17 in order to connect immovably the pressure member to the extension part. In the embodiment shown, the locking members 27 are formed in that windows 31 are recessed in the tongues 25. The part of the tongue located between the window 31 and the free end of the tongue 25 then constitutes the locking member. It is also possible to provide the tongues 25 with locking members in a different manner, for example in that a projection is arranged on the inner side of each tongue near the free end.

The outer surface of the extension part 17 is further provided with second projections 33 in the form of barbed hooks, which are arranged at a greater distance from the tubular part 9 than the first projections in the form of barbed hooks and are thus arranged at a higher level in FIGS. 2 and 3. These second projections in the form of barbed hooks can also cooperate with the locking members 27 of the resilient tongues 25 in order to secure the pressure member 21 in the first position on the extension part 17. This is shown in FIG. 2. This affords the advantage that the transformer, inclusive of the sealing member 19 and the pressure member 21, can be delivered and can be mounted in a television receiver without the risk of the sealing member or the pressure member being lost. After the high-voltage cable 7 has been introduced, the pressure member 21 can be brought into the second position, in which the locking members 27 snap behind the projections 29 in the form of barbed hooks, as can be seen in FIG. 3.

After the pressure member 21 has been fixed in the second position, the high-voltage cable 7 is clamped in the sealing member 19. However, this clamping is generally not sufficient to prevent that the connection between the cable and the contact member 11 (FIG. 1) is disengaged when the cable is subjected to a tensile force. Therefore, the pressure member 21 is provided at the end remote from the tubular part 9 with a tubular holder 35, in which a tensile relief member 37, 39 is secured. In the embodiment shown, the tensile relief member 37, 39 consists of, for example, a ring 37, at which two diametrically arranged resilient tongues 39 are arranged, which extend in axial direction and are directed towards the tubular part 9. On its inner side each tongue 39 is provided with a third projection 41 in the form of a barbed hook. This third projection in the form of a barbed hook projects over such a distance that, after the high-voltage cable 7 has been introduced, it penetrates into the insulation sheath so that the cable can no longer be withdrawn. Thus, the tensile relief member of the cable is obtained automatically in a very simple manner. Of course, if desired, more than two resilient tongues 39 with projections 41 may be uniformly distributed along the circumference of the ring 37. It is also possible to use a differently constructed tensile relief member, the tensile relief then being obtained, for example, by tightening a screw.

Since in the embodiment shown the cable 7 after its introduction can move only in one direction with respect to the tensile relief member 37, 39, this tensile relief member cannot follow the movement of the pressure member in the direction of the tubular part 9 when the pressure member is moved from the first to the second position. Therefore, the tensile relief member 37, 39 is secured in the tubular holder 35 in such a manner that the tubular holder 35 is movable with respect to the tensile relief member 21 in axial direction over a distance which is at least equal to the distance over which the pressure member must be displaced to be brought from the first to the second position. For this purpose, outwardly directed projections 43 are formed at the tongues 39, which projections are passed into windows 45 which are recessed in the wall of the tubular holder 35. The dimension in axial direction of these windows is larger than the distance between the first projections 29 in the form of barbed hooks and the second projections 33 in the form of barbed hooks so that the tensile relief member 37, 39 has a sufficient mobility in axial direction. Since the projections 43 cannot extend beyond the boundaries of the windows 45, the tensile relief member 37, 39 can be arranged in the holder 35 beforehand without the risk occurring that it is lost during the transport of mounting of the transformer.

We claim:

1. In a device having an electrically insulating housing containing an electrical contact, and a connection member for securing a high voltage cable having an insulation sheath to said housing with said cable connected to said contact, said connection member having an electrically insulative tubular part having a first end located within said housing and a second end projecting from said housing, the inner diameter of said tubular part being greater than or equal to the outer diameter of the high voltage cable to be received therein, the improvement comprising:

said second end having a tubular extension portion with an inner diameter larger than said inner diameter of said tubular part, an elastic electrically insulating sealing member disposed within said extension portion, said sealing member being a hollow cylinder having an outer diameter at most equal to the inner diameter of the extension portion and an inner diameter substantially equal to the outer diameter of the insulation sheath, said sealing member surrounding the cable when said cable is received in said tubular part, a tubular pressure member for compressing the sealing member against said tubular part and the insulation sheath of the cable received therein, said tubular pressure member being axially movable between a first position, in which the sealing member is not deformed and said cable is insertable through said pressure member and sealing member into said tubular part, and a second position in which said pressure member compresses the sealing member in the axial direction so that the sealing member completely fills the space between the insulation sheath of the cable and the inner surface of said extension portion, and locking means for locking said pressure member in said second position upon axial movement of said pressure member from said first position to said second position, said locking means comprising first projections on an outer surface of said extension portion and resilient tongues on said pressure member, said resilient tongues extending axially towards said tubular part along the outer surface of said extension portion when said pressure member is arranged thereon, said tongues having locking cams near their free ends for locking with said first projections of said extension portion to lock said pressure member in said second position.

2. In a device as claimed in claim 1, characterized in that said outer surface of said extension portion further comprises second projections arranged at a greater distance from said tubular part than said first projections, said second projections being cooperable with said locking cams of said resilient tongues for securing said pressure member on said extension portion in said first position.

3. In a device as claimed in claim 2, characterized in that said pressure member comprises, at its end remote from said tubular part, a tubular holder having a tensile relief member for fixedly engaging an insulation sheath of a cable received in said connection member, said tensile relief member being secured in said tubular holder such that said tubular holder is axially movable with respect to said tensile relief member over a distance which is at least equal to the distance over which said pressure member is displaceable on said extension portion between said first and second positions.

4. In a device as claimed in claim 3, characterized in that said tensile relief member consists of a ring having a plurality of resilient tongues, which tongues extend axially towards said tubular part and are provided at their inner surface with third projections for penetrating into the insulation sheath of a said cable received in said connection member.

5. In a device as claimed in claim 1, characterized in that said pressure member comprises, at its end remote from said tubular part, a tubular holder having a tensile relief member for fixedly engaging an insulation sheath of a cable received in said connection member, said tensile relief member being secured in said tubular holder such that said tubular holder is axially movable with respect to said tensile relief member over a distance which is at least equal to the distance over which said pressure member is displaceable on said extension portion between said first and second positions.

6. In a device as claimed in claim 5, characterized in that said tensile relief member consists of a ring having a plurality of resilient tongues, which extend axially towards said tubular part and are provided at their inner surface with third projections for penetrating into the insulation sheath of a cable received in said connection member.

7. A connection member for securing a high voltage cable having an insulation sheath, said connection member having an electrically insulative tubular part having a first end and an opposing second end, the inner diameter of said tubular part being greater than or equal to the outer diameter of the insulation sheath of a cable to be received in said connection member, the improvement comprising:

said second end of said connection member having a tubular extension portion with an inner diameter larger than said inner diameter of said tubular part, an elastic electrically insulating sealing member disposed within said extension portion, said sealing member being a hollow cylinder having an outer diameter at most equal to the inner diameter of said extension portion and an inner diameter substantially equal to the outer diameter of the insulation sheath of the high voltage cable, said sealing member surrounding the cable when said cable is received in said tubular part, a tubular pressure member for compressing said sealing member against the tubular part and the insulation sheath of the cable, said tubular pressure member being axially movable between a first position, in which the sealing member is not deformed and said cable is insertable through said pressure member and sealing member into said tubular part, and a second position in which said pressure member compresses the sealing member in the axial direction so that the sealing member completely fills the space between the insulation sheath of the cable and the inner surface of said extension portion, and locking means for locking said pressure member in said second position upon axial movement of said pressure member from said first position to said second position, said locking means comprising first projections on an outer surface of said extension portion and resilient tongues on said pressure member, said resilient tongues extending axially towards said tubular part along the outer surface of said extension portion when said pressure member is arranged thereon, said tongues having locking cams near their free ends for locking with said first projections of said extension portion to lock said pressure member in said second position.

8. A connection member as claimed in claim 7, characterized in that said pressure member comprises, at its end remote from said tubular part, a tubular holder having a tensile relief member for fixedly engaging an insulation sheath of a cable received in said connection member, said tensile relief member being secured in said tubular holder such that it is axially movable with respect to said holder over a distance which is at least equal to the distance over which said pressure member is displaceable on said extension portion between said first and second positions.

9. A connection member as claimed in claim 8, characterized in that said tensile relief member consists of a ring having a plurality of resilient tongues, which tongues extend axially towards said tubular part and are provided at their inner surface with third projections for penetrating into the insulation sheath of a cable received in said connection member.

10. A connection member as claimed in claim 7, characterized in that said extension portion further comprises second projections arranged at a greater distance from said first end of said tubular part than said first projections, said second projections being cooperable with said locking cams of said resilient tongues for securing said pressure member on said extension portion in said first position.

11. A connection member as claimed in claim 10, characterized in that said pressure member comprises, at its end remote from said tubular part, a tubular holder having a tensile relief member for fixedly engaging an insulation sheath of a cable received in said connection member, said tensile relief member being secured to said tubular holder such that said tubular holder is axially movable with respect to said tensile relief member over a distance which is at least equal to the distance over which said pressure member is displaceable between said first and second positions.

12. A connection member as claimed in claim 11, characterized in that said tensile relief member consists of a ring having a plurality of resilient tongues, which tongues extend axially towards said tubular part and comprise third projections at their inner surface for penetrating into the insulation sheath of a cable received in said connection member.

* * * * *